US006026969A

United States Patent [19]

Okui

[11] Patent Number: 6,026,969

[45] Date of Patent: Feb. 22, 2000

[54] DISPLAY STAND

[76] Inventor: Hisashi Okui, 2-134-40, Hikino-cho, Sakai-shi, Osaka 591, Japan

[21] Appl. No.: 08/876,340

[22] Filed: Jun. 16, 1997

[30] Foreign Application Priority Data

Nov. 19, 1996 [JP] Japan ..... 8-011829

[51] Int. Cl.[7] ..... A47F 7/00

[52] U.S. Cl. ..... 211/14; 211/189

[58] Field of Search ..... 211/60.1, 189, 211/14, 85.7; D6/562; 248/165, 176.1, 431

[56] References Cited

U.S. PATENT DOCUMENTS 2,759,780 8/1956 Barker, Jr. ..... 248/431 X 3,396,933 8/1968 Ward ..... 248/431

4,540,308 9/1985 Colby ..... 211/189 X

FOREIGN PATENT DOCUMENTS 49-66586 6/1974 Japan .

*Primary Examiner*—Daniel P. Stodola

*Attorney, Agent, or Firm*—Darby & Darby

[57] ABSTRACT

A display stand for displaying an ornament, the stand being assembled with a single plain bar and five bars having recesses dimensioned and shaped to match the contours of portions of bars so as to engage or receive the bars within corresponding recesses.

2 Claims, 8 Drawing Sheets

DISPLAY STAND

BACKGROUND OF THE INVENTION

1. Field of the Invention

The present invention relates to a display stand, and more particularly to a stand for displaying an ornament, the stand being assembled with a single plain bar and five bars having recesses dimensioned and shaped to match the contours of portions of bars so as to engage or receive the bars within corresponding recesses.

2. Description of Related Art

The inventor made an invention which is disclosed in Japanese Utility Model Laid-Open Specification No. 49-66586. This prior invention will be described with reference to FIG. 8.

The illustrated stand is made up of six cylindrical bars, three of them functioning as legs and the other three functioning as arms, among which five bars are provided with recesses adapted to allow a cylindrical portion (hereinafter referred to as "barrel") of the bar to fit in. The bars are assembled into a display stand by engagement of the barrels of the bars with the recesses. The assembled stand stands on the three legs whose end portions provides a display space where an ornamental object such as a baseball is placed. The arms ornamentally extend like a wing as shown in FIG. 1.

The bars D1 each include a pair of semi-circular recesses C2 with a partition C1 therebetween. The bar D2 is provided with an axially extending flat recess defined by semi-circular walls and a semi-circular recess C4 vertically cut from the rim of the flat recess C3. The bars D3 each are provided with a semi-circular recess C5 defined by semicircular walls and a semi-circular recess C6 vertically cut from the rim of the recess C5. The bar D4 is a plain bar having no recess. The internal semi-circular contour of each recess is designed to allow a barrel of each bar to smoothly fit in.

The known display stand has a disadvantage that when it is assembled, a gap is produced between the bars arranged side by side in the recess C3 of the bar D2. The gap results in the fragility of the display stand, so that it collapse under a relatively heavy ornament such as metal.

SUMMARY OF THE INVENTION

It is an object of the present invention to provide a display stand which is tough and stable even under a relatively heavy object.

According to the present invention the display stand is assembled with a single plain bar and five bars having recesses dimensioned and shaped to match the contours of portions of bars so as to engage or receive the bars within corresponding recesses.

The above and further objects and features of the invention will more fully be apparent from the following detailed description with the accompanying drawings.

DESCRIPTION OF THE PREFERRED EMBODIMENTS

Figure 1:
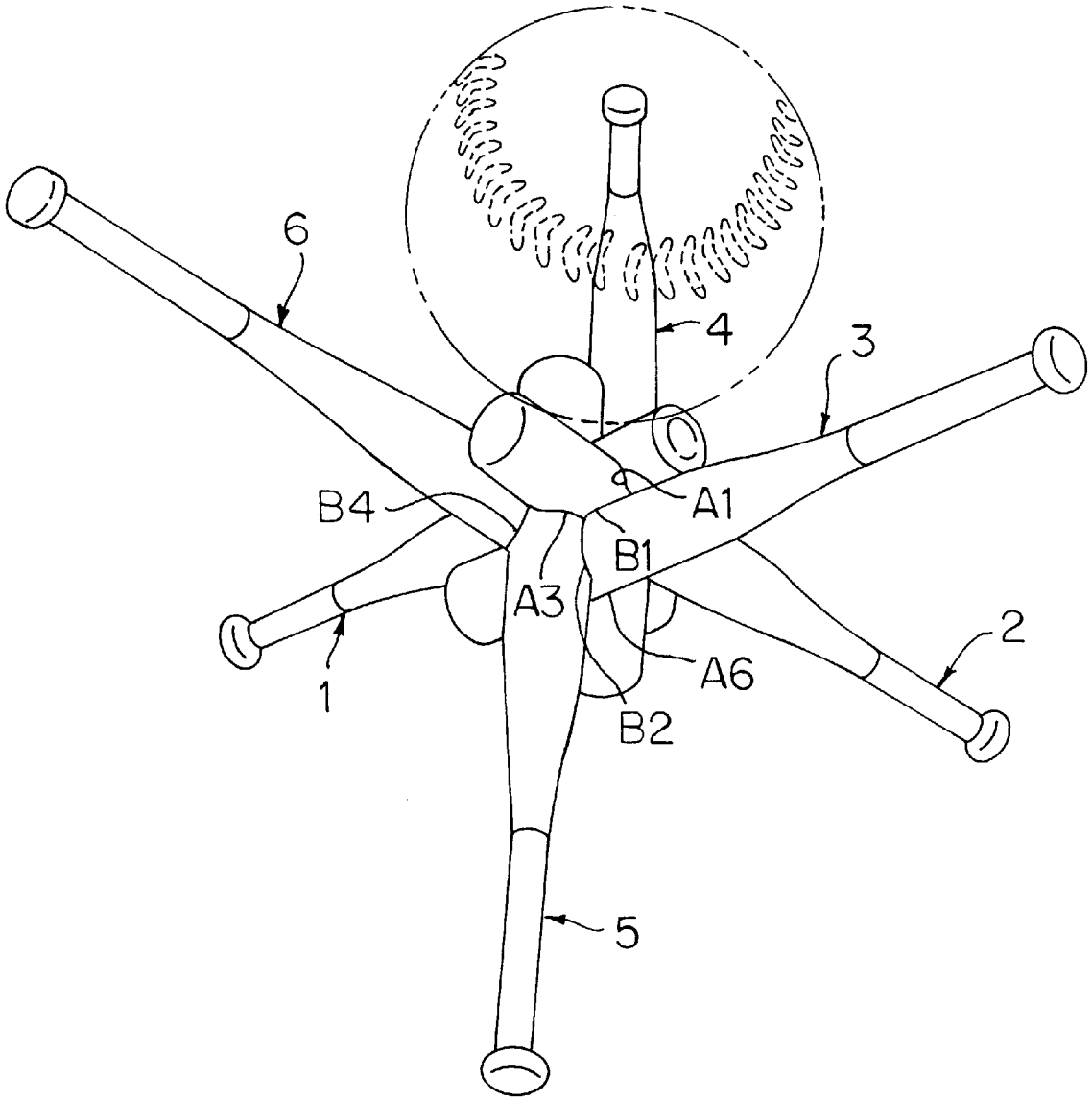
FIG. 1 is a perspective view illustrating a display stand according to present invention.
Figure 2:
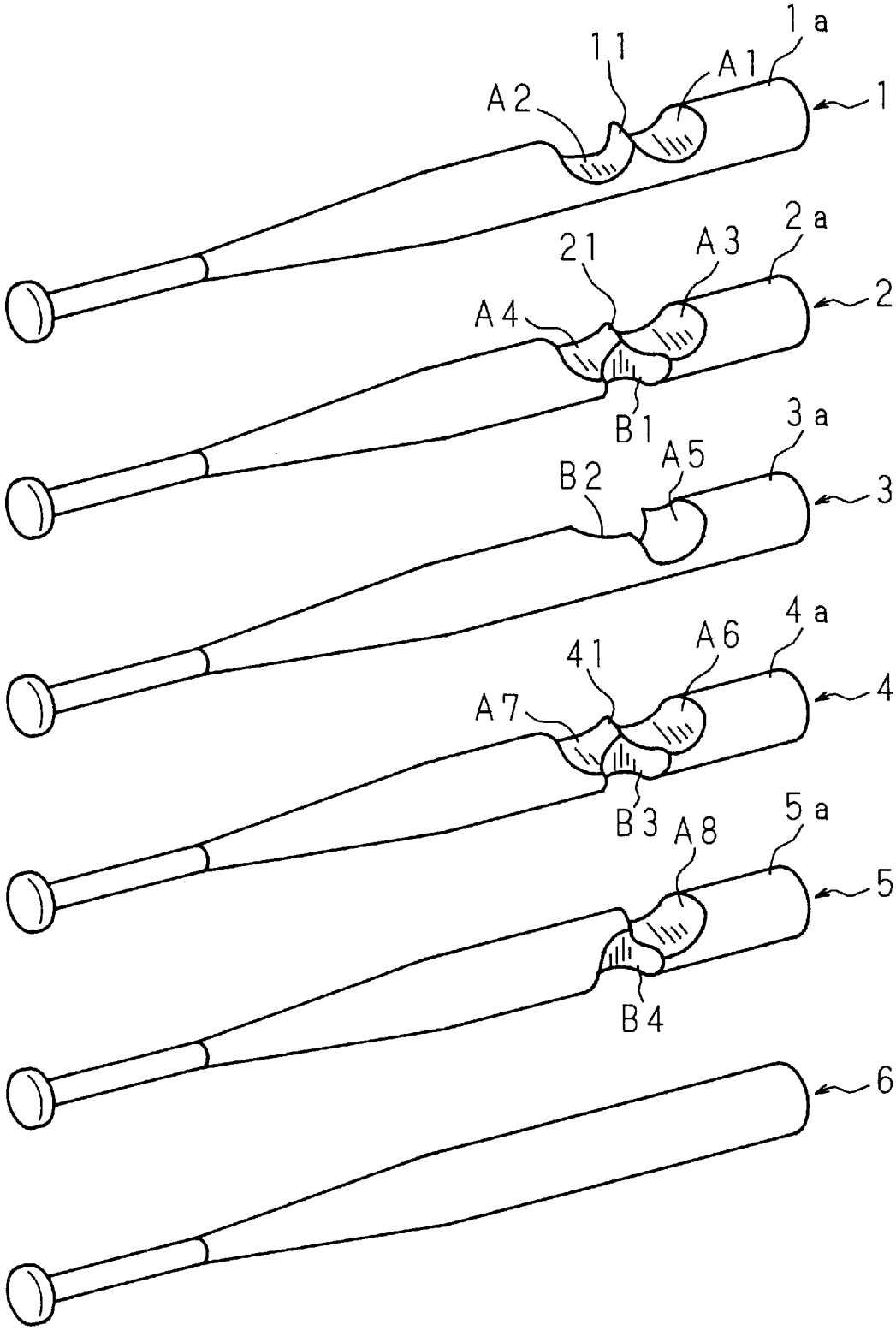
FIG. 2 is an exploded perspective view illustrating the bars used for assembling the display stand.

The present invention will be more particularly described with reference to the accompanying drawings which illustrates the embodiments of the invention:

Referring to FIGS. 1 and 2, the exemplary display stand of the present invention is made up of six bars 1 to 6 shaped like a baseball bat having a handle and a barrel. The bar 6 is a plain bar. The reference numerals 1*a* to 5*a* denote an end portion of each bar which provides a space for allowing an ornament to rest in, hereinafter referred to as "an object accepting portion". Each of the bars 1 to 5 has one or two recesses, and the bar 6 is a plain bar with no recess. More specifically, the bar 1 is provided with a pair of semi-circular top recesses A1 and A2 formed side by side with a partition 11 extending diametrically therebetween, wherein the term "top" is used for explanation's convenience so as to distinguish the recesses on the top surface from those produced on the side of the barrel of the bar, which will be referred to as "side recess".

The bar 2 is provided with a pair of semi-circular top recesses A3 and A4 having a partition 21 therebetween, and a semi-circular side recess B1 vertically cut from the rims of the top recesses A3 and A4.

The bar 3 is provided with a semi-circular top recess A5, and a semi-circular side recess B2 vertically cut from the rim of the top recess A5.

The bar 4 is provided with a pair of semi-circular top recesses A6 and A7 having a partition 41 therebetween, and a side recess B3 vertically cut from the rims of the top recesses A6 and A7.

The bar 5 is provided with a semi-circular top recess A8, and a semi-circular side recess B4 vertically cut from the rim of the top recess A8.

The semi-circular top recesses A1 to A8 are formed adjacent to the respective object accepting portions 1*a* to 5*a*. The depth of each of the semi-circular recesses A1 to A8 and B1 to B4 is virtually half the diameter of the object accepting portion of the bar 1 to 5. The axes of the top recesses A1 to A8 and the side recesses B1 to B4 cross each other.

The bars 1 to 6 can be made of wood, synthetic resins such as acrylic resins, metal such as aluminum or any other substance. The shape of the bars is not limited to a baseball bat but can be like a tennis racket or a golf club mainly depending on the object to be displayed. If the object is a tennis ball or a golf-ball, racket-shaped bars or golf-club shaped bars are recommended.

Figure 3:
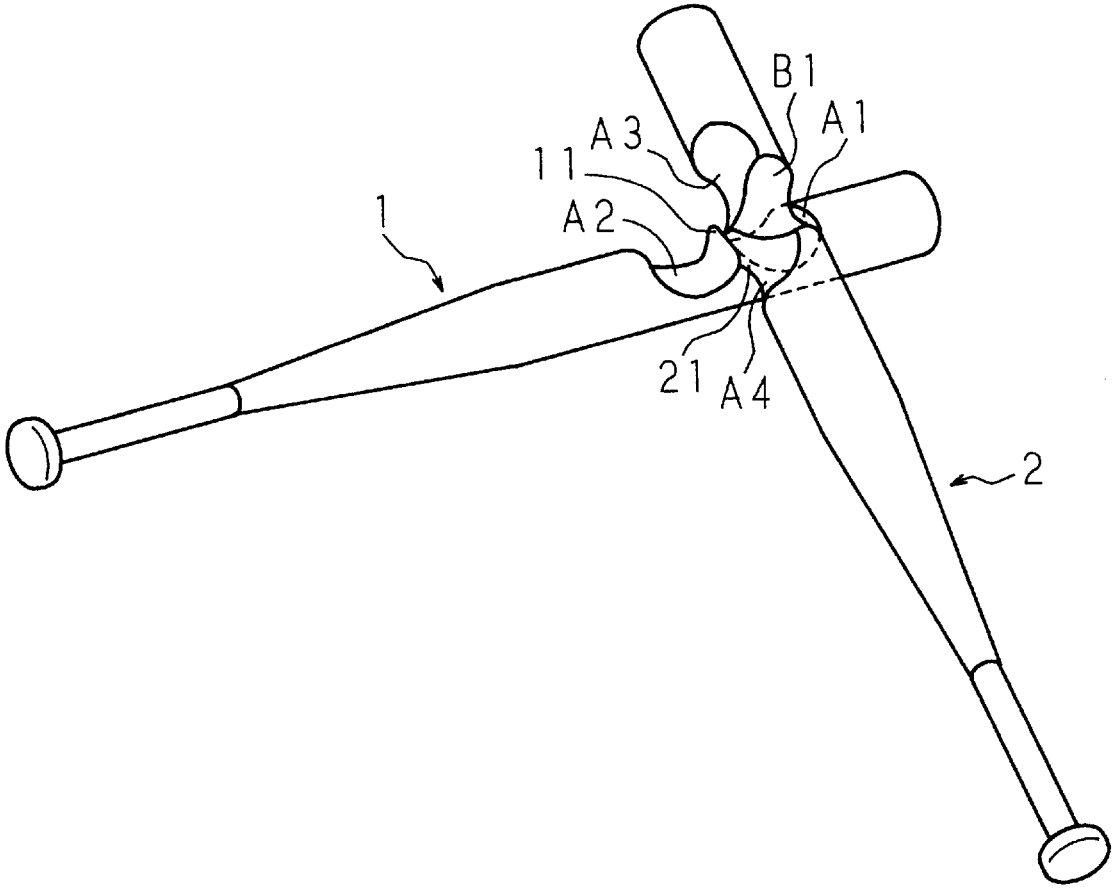
FIG. 3 is a perspective view illustrating a first step of assembling the display stand.

Now, referring to FIGS. 3 to 7, the steps of assembling the display stand with the bars 1 to 6 will be described:

The first step shown in FIG. 3 consists of holding the bar 1 with the top recesses A1 and A2 upward, and fitting the barrel of the bar 2 in the top recess A1 with its top recesses A3 and A4 sideways and the side recess B1 upward.

Figure 4:
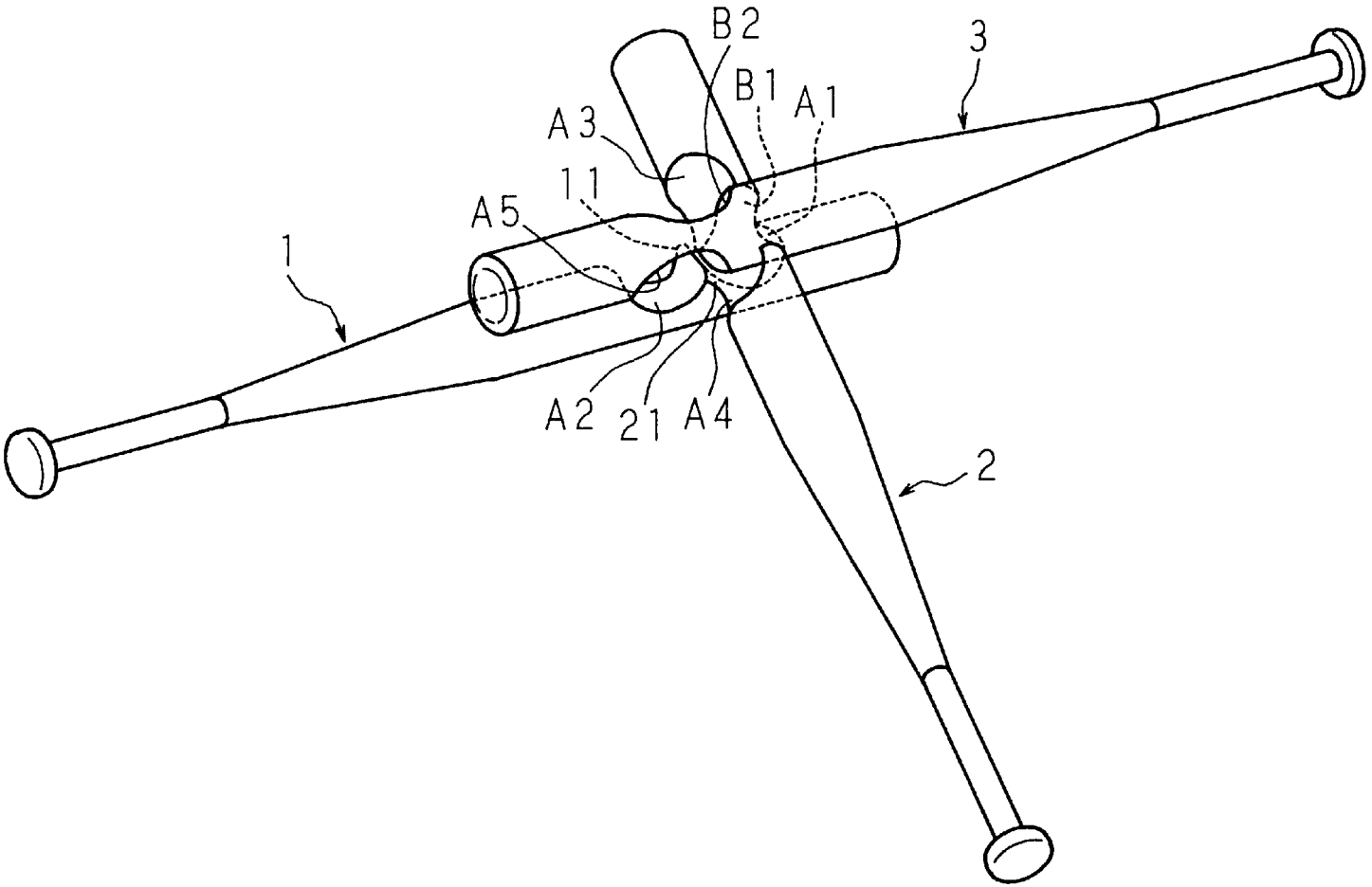
FIG. 4 is a perspective view illustrating a second step of assembling the display stand.

The second step shown in FIG. 4 consists of fitting the barrel of the bar 3 in the side recess B1 of the bar 2 with its side recess B2 kept vertical, and its top recess A5 facing the top recess A2 of the bar 1, thereby producing a circular passageway between the top recesses A2 and A5.

Figure 5:
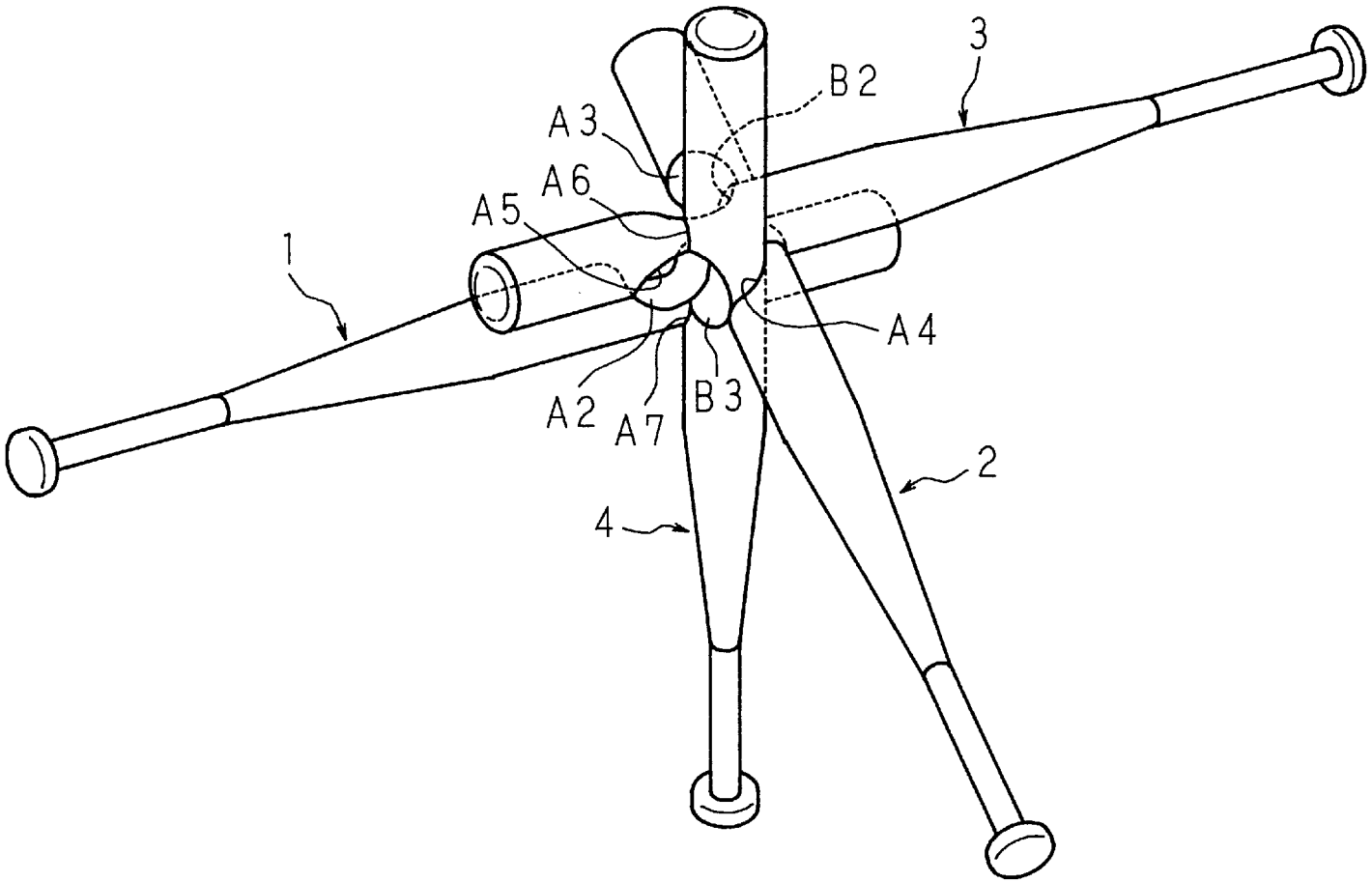
FIG. 5 is a perspective view illustrating a third step of assembling the play stand.

The third step shown in FIG. 5 consists of fitting the barrel of the bar 4 held upright in the top recess A4 of the bar 4 with its top recess A6 receiving the barrel of the bar 3 and another top recess A7 receiving the barrel of the bar 1, wherein the side recess B3 communicates with the circular passageway defined between the top recesses A2 and A5.

Figure 6:
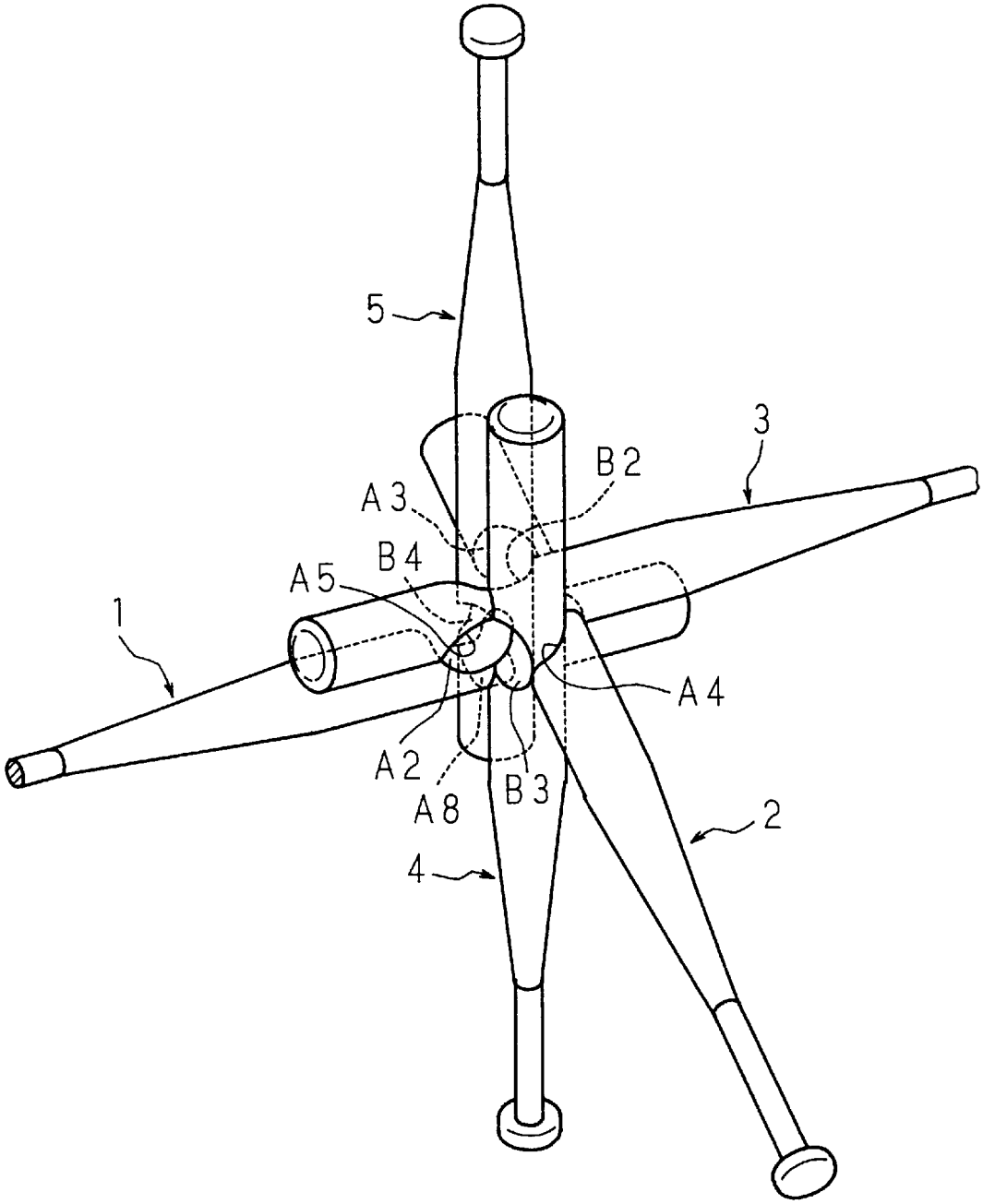
FIG. 6 is a perspective view illustrating a fourth step of assembling the play stand.

The fourth step shown in FIG. 6 consists of fitting the barrel of the bar 5 held upright in the side recess B2 of the bar 3 and the top recess A3 of the bar 2, with its top recess A8 receiving the barrel of the bar 1, wherein the side recess B4 communicates with the circular passageway defined between the top recesses A2 and A5.

Figure 7:
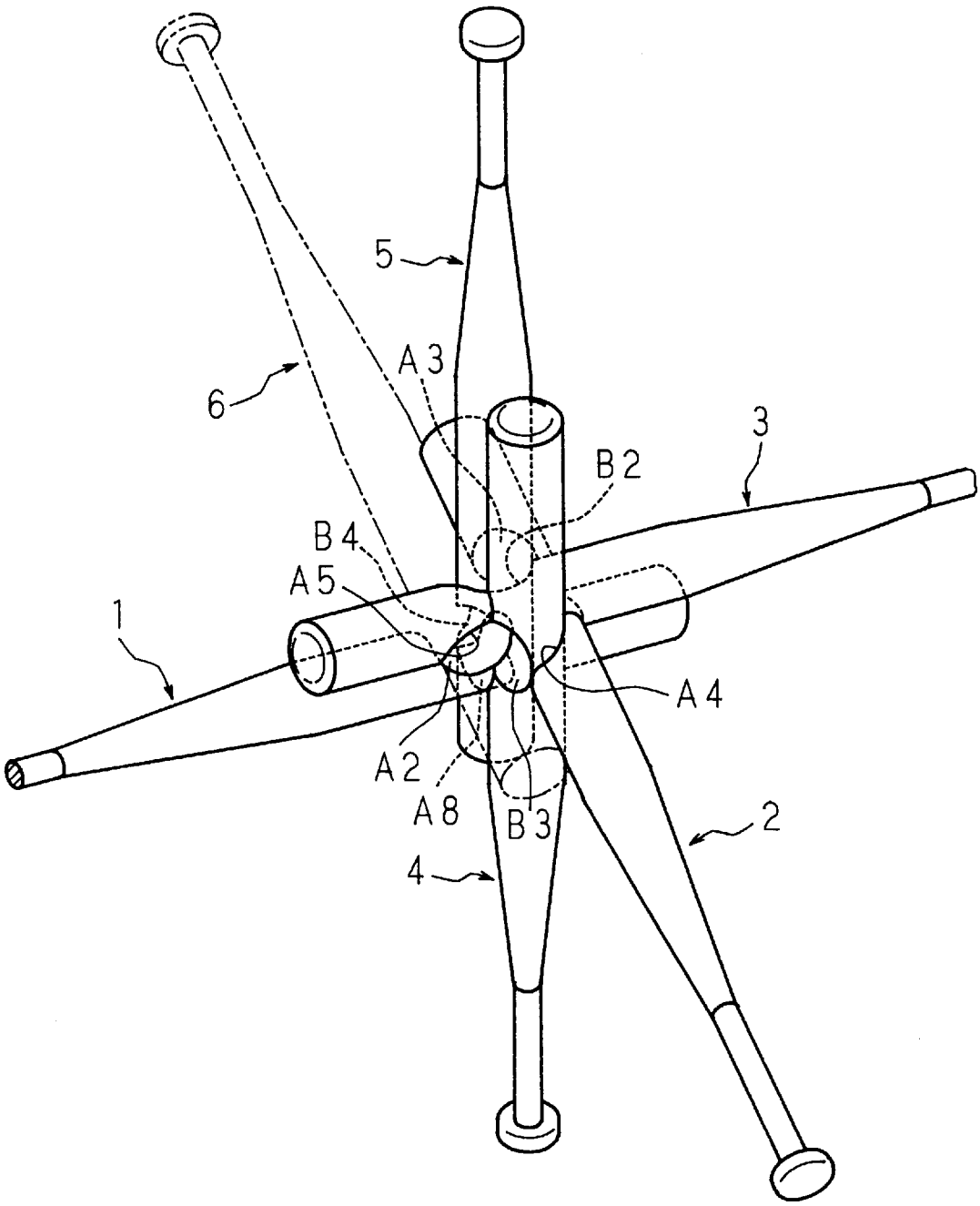
FIG. 7 is a perspective view illustrating a fifth step of assembling the display stand.
Figure 8:
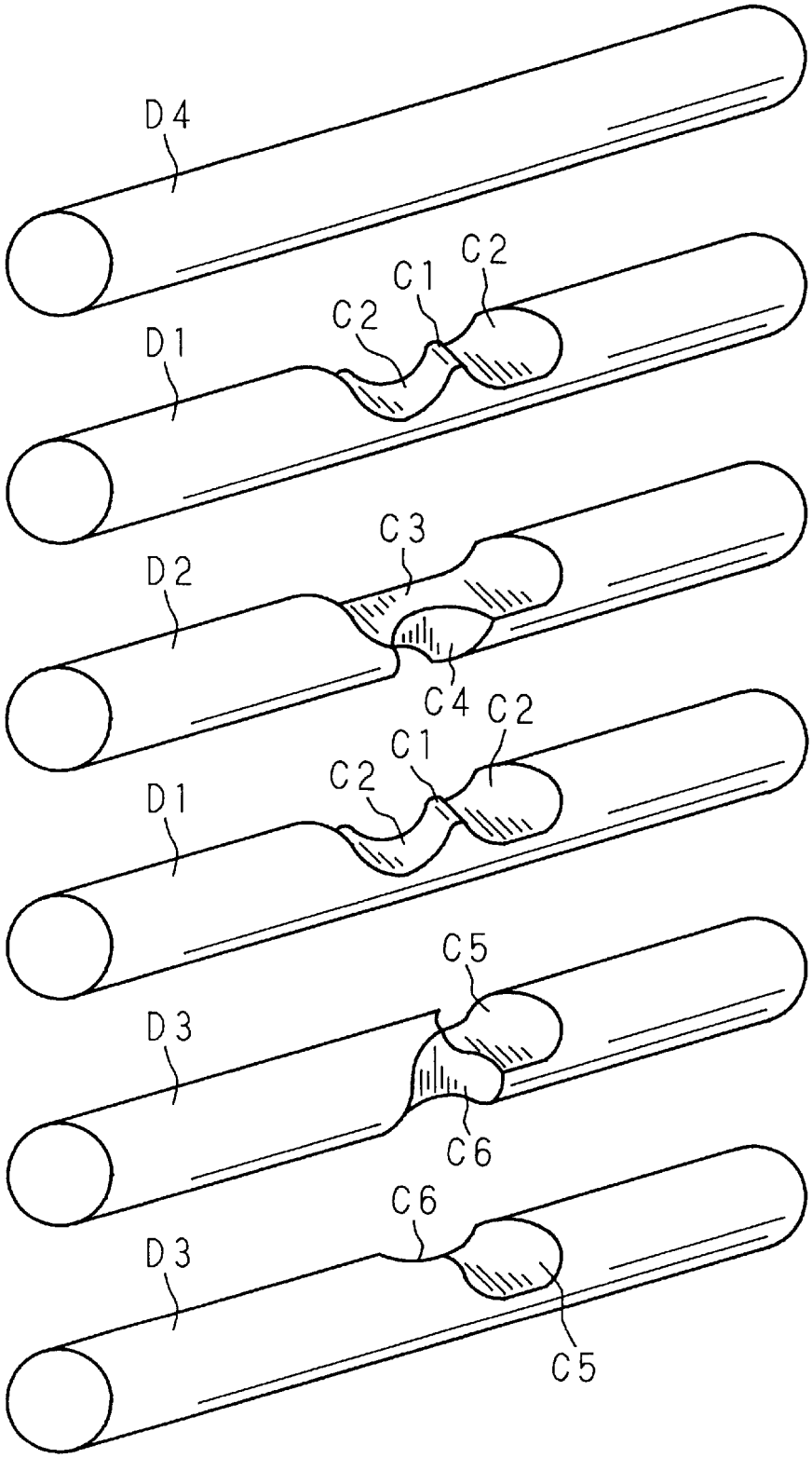
FIG. 8 is an exploded perspective view illustrating the bars used for assembling a prior art display stand.

The final step shown in FIG. 7 consists of inserting the plain bar 6 from the side of the bar 5 through both the circular passageway defined between the top recesses A2 and A5 and the side recesses B3 and B4 communicating with the circular passageway. In this way the display stand shown in FIG. 1 is assembled.

In the exemplary display stand the bars 1, 2 and 5 function as legs, and the bars 3, 4 and 6 function as arms. It is possible to turn the display stand upside down in which the bars 3, 4 and 6 work as legs, and the bars 1, 2 and 5 work as arms.

According to the present invention, the display stand is robust and firm because of having no gaps, so that even an unstable object can be safely placed. When thick and large bars are used, the assembled stand can be used as a sitting stool or a small desk, particularly for outdoor use. The partitions 11, 21 and 41 of the bars 1, 2 and 4 normally have an apex ridge, or alternatively, a slightly flat ridge can be used provided that the width thereof is not such as to produce a large gap between the bars.

As this invention may be embodied in several forms without departing from the spirit of essential characteristics thereof, the present embodiments are therefore illustrated and not restrictive, since the scope of the invention is defined by the appended claims rather than by the description preceding them, and all changes that fall within metes and bounds of the claims, or equivalence of such metes and bounds thereof are therefore intended to be embraced by the claims.

I claim:

1. A display stand for displaying an ornament, the stand being assembled with a plain bar which is free of recesses and a plurality of bars each having a recess matching the contour of a portion of another bar so as to engage or receive the bars within corresponding recesses, wherein the plurality of bars comprises:

a first bar including a pair of semi-circular first top recesses and a first partition defined by a ridge between the recesses and extending laterally to the length of the bar to separate the first and second top recesses, said first top recesses overlapping to form said ridge;

a second bar including a pair of semi-circular second top recesses, a second partition defined by a ridge between the recesses and extending laterally to the length thereof to separate the second top recesses, and a semi-circular first side recess vertically cut from the rims of the second top recesses;

a third bar including a semi-circular third top recess and a semi-circular second side recess vertically cut from the rim of the third recess;

a fourth bar including a pair of semi-circular fourth recesses, a third partition extending laterally of the length thereof to separate the fourth top recesses, and a semi-circular third side recess vertically cut from the rims of the fourth top recesses; and a fifth bar including a semi-circular fifth recess and a semi-circular fourth side recess vertically cut from the rim of the fifth top recess;

wherein the first to the fifth top recesses are equally spaced from one end of each of the first to fifth bars.

2. The display stand according to claim 1, wherein each of the first to third partitions is provided with an acute ridge.

* * * * *